US008059043B2

(12) United States Patent
Brady, Jr. et al.

(10) Patent No.: US 8,059,043 B2
(45) Date of Patent: Nov. 15, 2011

(54) WINDOW MOUNTED ANTENNA FOR A VEHICLE AND A METHOD FOR USING THE SAME

(75) Inventors: Kenneth A. Brady, Jr., Trabuco Canyon, CA (US); George Treneer, Oceanside, CA (US)

(73) Assignee: Thales Avionics, Inc., Irvine, CA (US)

( * ) Notice: Subject to any disclaimer, the term of this patent is extended or adjusted under 35 U.S.C. 154(b) by 0 days.

(21) Appl. No.: 12/620,741

(22) Filed: Nov. 18, 2009

(65) Prior Publication Data

US 2010/0066616 A1 Mar. 18, 2010

Related U.S. Application Data

(62) Division of application No. 11/699,276, filed on Jan. 26, 2007, now Pat. No. 7,642,974.

(51) Int. Cl.
*H01Q 1/28* (2006.01)

(52) U.S. Cl. ..... 343/705; 343/713

(58) Field of Classification Search ..... 343/705, 343/708, 711, 713

See application file for complete search history.

(56) References Cited

U.S. PATENT DOCUMENTS

| | | | | |
|---|---|---|---|---|
| 3,906,507 | A * | 9/1975 | Allen, Jr. | 343/705 |
| 3,945,014 | A | 3/1976 | Kunert et al. | |
| 4,352,200 | A * | 9/1982 | Oxman | 455/41.2 |
| 4,541,595 | A | 9/1985 | Fiala et al. | |
| 5,214,436 | A | 5/1993 | Hannan | |
| 5,248,985 | A * | 9/1993 | Hammerle | 342/457 |
| 6,218,932 | B1 * | 4/2001 | Stippler | 340/426.16 |
| 6,302,358 | B1 | 10/2001 | Emsters et al. | |
| 7,483,696 | B1 * | 1/2009 | Mitchell | 455/431 |
| 2006/0270354 | A1 * | 11/2006 | de La Chapelle et al. | 455/66.1 |
| 2007/0001809 | A1 * | 1/2007 | Kodukula et al. | 340/10.1 |

* cited by examiner

*Primary Examiner* — Tho G Phan

(74) *Attorney, Agent, or Firm* — Myers Bigel Sibley & Sajovec, P.A.

(57) ABSTRACT

An antenna assembly for installation in a vehicle, such as an aircraft, and a method for using the same. The antenna assembly includes at least one window mounted antenna for an aircraft for enabling the aircraft to communicate wirelessly with a network, such as a Metropolitan Area Network (MAN). The window mounted antenna includes a panel that is transparent to visible light and has at least one antenna element, which can be etched onto the panel. The panel can attach to the interior window of the aircraft, or to an inner surface of the inner pressure window of the aircraft, or can replace the interior window, so as to position the antenna element in a side-looking direction with respect to the aircraft.

31 Claims, 4 Drawing Sheets

WINDOW MOUNTED ANTENNA FOR A VEHICLE AND A METHOD FOR USING THE SAME

CROSS-REFERENCE TO RELATED PATENT APPLICATION

This patent application is a divisional of U.S. patent application Ser. No. 11/699,276, filed Jan. 26, 2007, now allowed, the content of which is incorporated herein by reference in its entirety for all purposes.

BACKGROUND OF THE INVENTION

1. Field of the Invention

The present invention relates to an antenna for installation in a vehicle, such as an aircraft, and a method for using the same. More particularly, the present invention relates to a window mounted antenna assembly for an aircraft for enabling the aircraft to communicate wirelessly with a network, such as a Metropolitan Area Network (MAN).

2. Description of the Related Art

The installation of traditional antennae in aircraft typically involve drilling holes through the skin of the aircraft on the top or bottom, mounting the desired antenna, and sealing the installed antenna, cable, and mounting holes sufficient to prevent compromise of the pressurized aircraft during flight. This is often a complicated and expensive installation that must be performed with great care due to the safety sensitive nature of the modification to the aircraft.

Since the antenna is intended to operate while the aircraft is on the ground and the communications are typically with ground-based network base stations or repeaters, the direction of the antenna should be towards the side of the aircraft ("side-looking") as opposed to away from the top or bottom of the aircraft. It is also desirable for the antenna to be capable of being installed with a minimum of cost and complexity, as well as having a minimal impact on the structure of the aircraft.

The industry has made several attempts to provide wireless communications to the aircraft while the aircraft is on the ground. One attempt is a system that has typically been called "GateLink" in the industry. The "GateLink" approaches have been accomplished by installing a network antenna, such as an IEEE 802.11a/b/g antenna, on the top of the aircraft, and using the antenna to communicate with a ground station. However, the "GateLink" system is disadvantageous because the system not only requires modification to the aircraft, but further requires modification to the gate at the airport, which is relatively difficult to accomplish efficiently.

Furthermore, an antenna installation that penetrates the pressure seal of the aircraft, such as that of the "GateLink" system, is expensive, complex, and difficult to certify. Also, top or bottom mounted antenna are well suited for aircraft communications in flight, but are far less effective when the device to which the aircraft is communicating is on the ground toward the horizon. On the contrary, a side-looking antenna mounted on the top or bottom of an aircraft would need to be undesirably tall and would still require holes to be drilled into the aircraft, with the resulting installation and certification complications. A side-looking top or bottom mounted antenna design would thus be highly custom, low in quantity, and relatively expensive.

BRIEF DESCRIPTION OF THE DRAWINGS

These and other objects, advantages and novel features of the invention will be more readily appreciated from the following detailed description when read in conjunction with the accompanying drawings, in which.

DETAILED DESCRIPTION OF THE PREFERRED EMBODIMENTS

As discussed in detail below, the present invention relates to an antenna assembly for installation in a vehicle, such as an aircraft, bus, boat or ship, and any other suitable vehicle, and a method for using the same. The antenna assembly is mountable in a window area of an aircraft to enable the aircraft to communicate wirelessly with a Metropolitan Area Network (MAN). Specifically, the antenna assembly is capable of supporting at or near-the-gate communications between the aircraft and a MAN using technology such a IEEE 802.16 that is located in the airport area but not necessarily at the airport itself. The antenna assembly is capable of supporting high speed communications between the aircraft and ground base stations or repeaters that are located within, for example, a 3 mile to 5 mile radius of the airport. Naturally, the repeaters or base stations can be disposed within any suitable range of the airport as can be appreciated by one skilled in the art.

Figure 1:
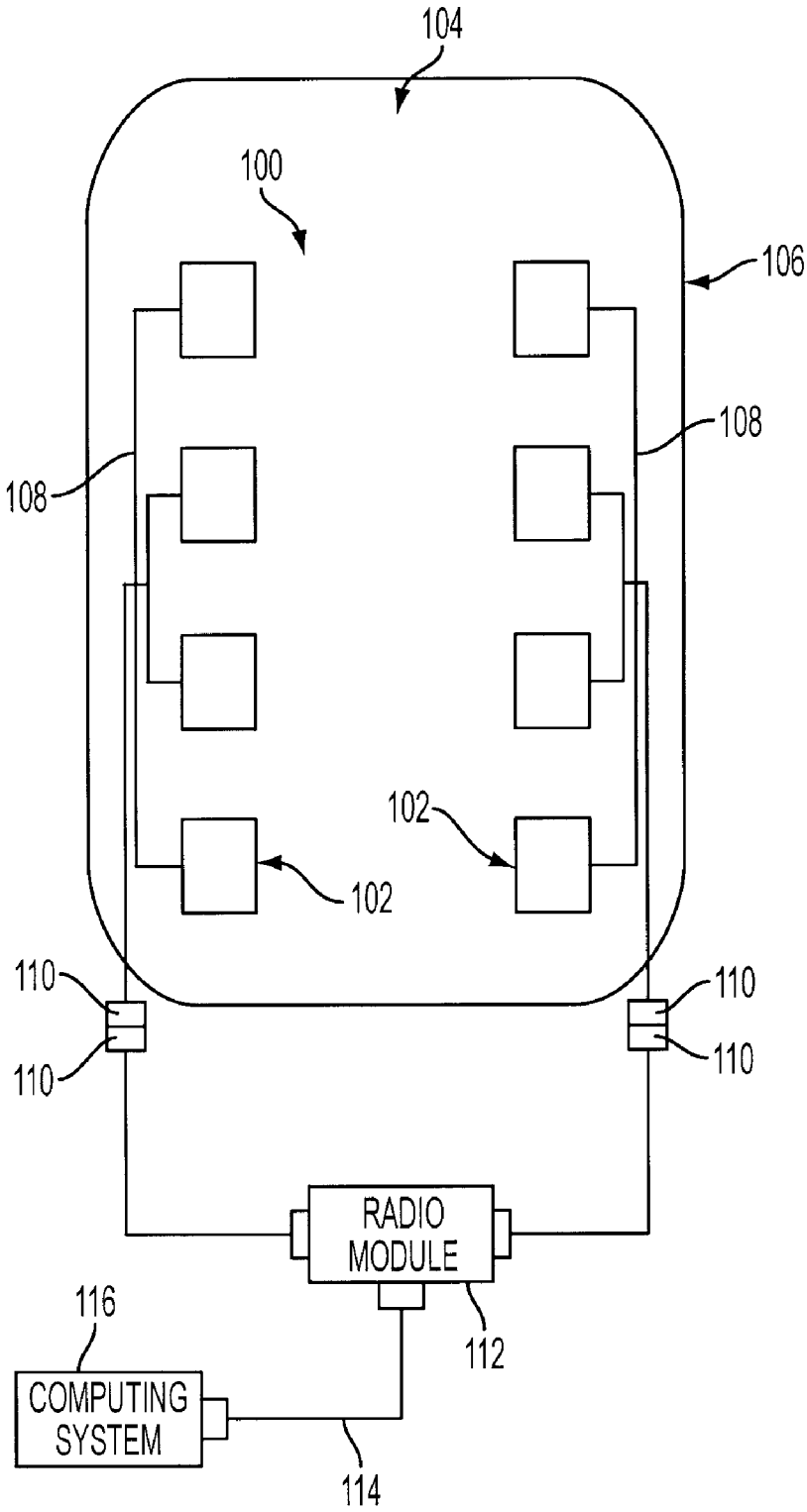
FIG. 1 is a conceptual diagram illustrating an example of an antenna assembly for mounting at a window area of an aircraft according to an embodiment of the present invention.

FIG. 1 is a conceptual block diagram illustrating an example of an antenna assembly 100 according to an embodiment of the present invention. The antenna assembly 100 comprises a plurality of antenna elements 102 that are mounted to a transparent antenna window insert panel 104 that can be placed in a window assembly 106 of an aircraft as discussed in more detail below. Each antenna element in this example is rectangular or square shaped, such as 1.2 inches square or about 1.2 inches square, but can be of any suitable shape and size and can be appreciated by one skilled in the art. The antenna elements 102 can be arranged in one or more groups of antenna elements 102 that achieve a narrowly focused vertical beam or coverage area, and a broadly focused horizontal beam or coverage area, as can also be appreciated by one skilled in the art. For example, multi-element antenna designs with narrow vertical and broad horizontal coverage are common in applications such as cell phone towers.

Since the aircraft will communicate with either a base station or repeater on the ground, a narrowly focused vertical beam will assist in maintaining the best signal at ground level without wasting energy by transmitting towards the sky or ground. Since the orientation of the aircraft 105 with respect to the base station or repeater will have great variation, a broad horizontal beam is desirable.

As further shown in FIG. 1, the antenna elements 102 can be etched onto a surface of the panel 104 as can be appreciated by one skilled in the art, or can be attached to a surface of the panel 104 by adhesive, fasteners or in any other suitable manner. The panel 104 is configured in the shape of, or substantially in the shape of, an aircraft window and is intended to be attached to the surface of an aircraft window assembly or to entirely replace an existing inner window in the aircraft window assembly, as discussed in more detail below. The panel 104 in this example is made of a clear, transparent or substantially transparent material that is compatible with aircraft certification requirements, such as Plexiglas, plastic or the like, so that the panel 104 allows visible light, or at least some light within the visible spectrum, to pass. Hence, the panel 104 can be located in a window used by a passenger with minimal viewing interference.

As further shown, the antenna elements 102 are coupled via conductors 108 to connectors 110. In this example, the conductors 108 can be conductive material that is etched to the panel 104 like the antenna elements 102, or can be wires, fiber optical threads, or any other suitable type of conduit that will enable signals to propagate between the antenna elements 102 and the connectors 110. The connectors 110 can be any suitable type of mating connector, and can be configured a combiner, multiplexer, and so on, that enables coupling of the conduits 108 to a radio module 112. The radio module 112 includes, for example, modulation and demodulation equipment as can be appreciated by one skilled in the art. The radio module 112 communicates with a computing system 116 via, for example, a local on board network 114 such as an Ethernet, wireless network or the like. The computing system 116 is located on the aircraft and can include servers, a computer or processor, and other control equipment and the like, as can be appreciated by one skilled in the art.

Figure 2:
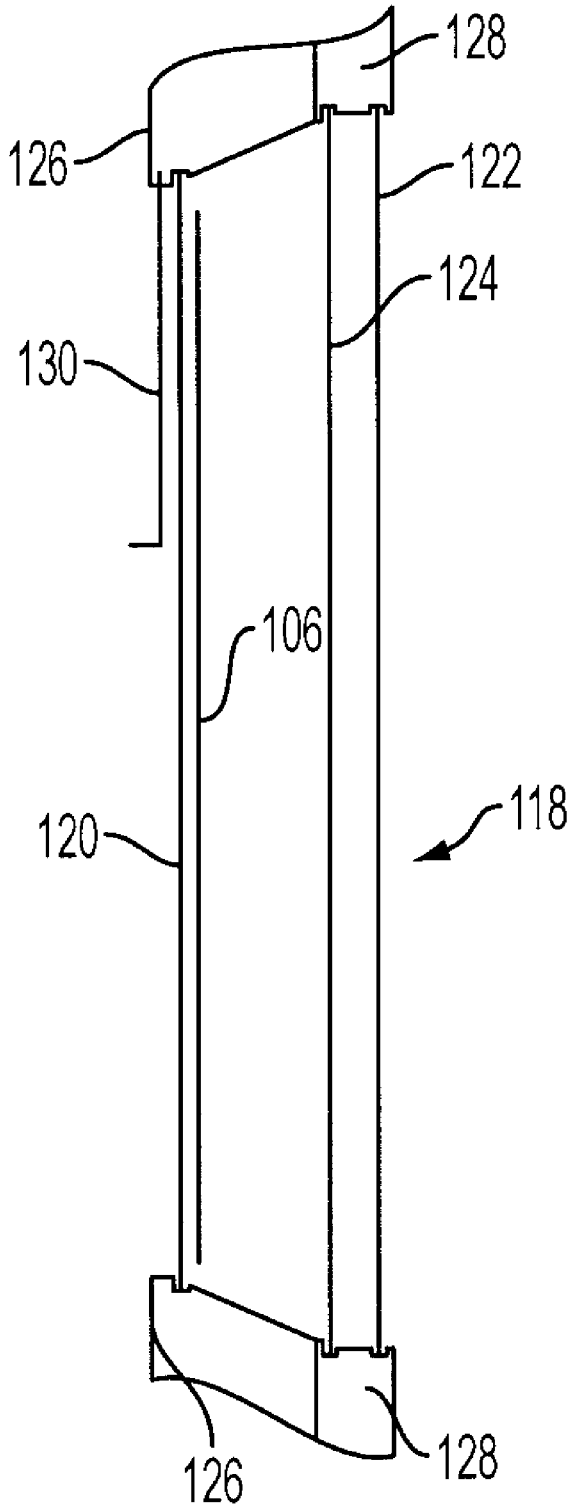
FIG. 2 is a cross-sectional view of an aircraft window including a window mounted antenna assembly as shown in FIG. 1.

FIG. 2 is an exemplary cross-sectional view of a window assembly 118 of an aircraft. As illustrated, the window assembly 106 includes an inner window 120 that the passengers can touch, and exterior pressure window 122, and an inside pressure window 124. The inner window 120 is typically made of plastic, Plexiglas, or any other suitable transparent material, and can be attached to or part of the interior side wall liner 126, while the exterior pressure window 122 and inside pressure window 124 are typically made of high strength glass or other suitable transparent material and is attached to the exterior structure 128 of the aircraft. The window assembly 118 can further include the usual features found in a passenger aircraft, such as a shade 130.

As discussed above, the antenna assembly 100 and, in particular, the panel 106, can have the shape and dimensions which enable the panel 106 to totally replace the existing inner window 120. This replacement window, in effect, would include the antenna assembly 100 including the panel 106 with the antenna elements 102, conductors 108 and connectors 110. Replacing the inner window 120 with the antenna assembly 100 reduces the amount of aircraft modification to the steps of removing a side-wall liner 126, removing the inner window 120, installing the antenna assembly 100, and re-installing the side-wall liner 126. The connectors 110 can be attached to their mating connectors 110 as shown in FIG. 1 during, for example, reinstallation of the side-wall liner, to couple the antenna elements 102 to the radio module 112.

Alternatively, the antenna assembly 100 can be attached to the inner or outer surface of the inner window 120 using, for example, a mechanical bracket, an adhesive, or any other suitable type of fastener, by performing the steps above. In this event, the inner window 120 is removed if the antenna assembly 100 is attached to the outer surface of the inner window 120. That is, if the antenna assembly 100 is attached to the outer surface of the inner window 120, which between the inner window 120 and the inside pressure window 124, the antenna assembly 100 will avoid contact by passengers or other personnel (e.g., flight attendants, maintenance crew) in the aircraft. Also, the antenna assembly 100 can be attached to the inside surface of the inside pressure window 124 by, for example, adhesive, or can simply be positioned between the inner window 120 and inside pressure window 124 by attachment to, for example, the interior side wall liner 126 by a mechanical bracket, adhesive or any other suitable type of fastener As can be appreciated by one skilled in the art, the radio module 112, and the computing system 116, can include controllers that can operate to enhance the signal as well as steer the beam in the horizontal directions. Such steering can be used to broaden the coverage of the aircraft.

Figure 3:
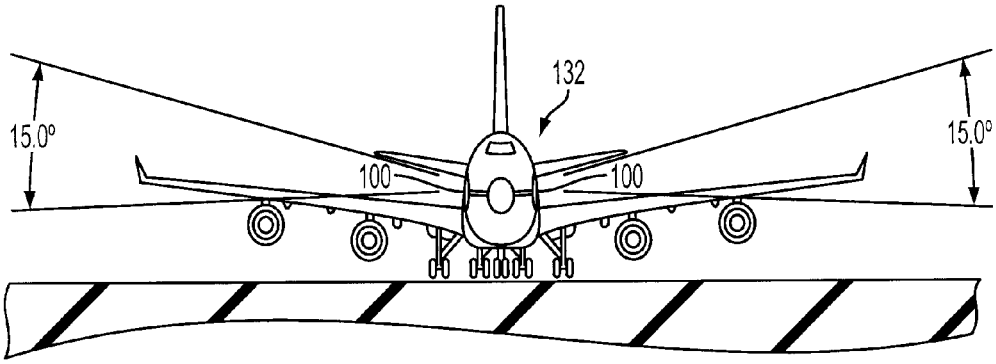
FIG. 3 illustrates an example of vertical coverage achieved by the antenna assembly as shown in FIG. 1.
Figure 4:
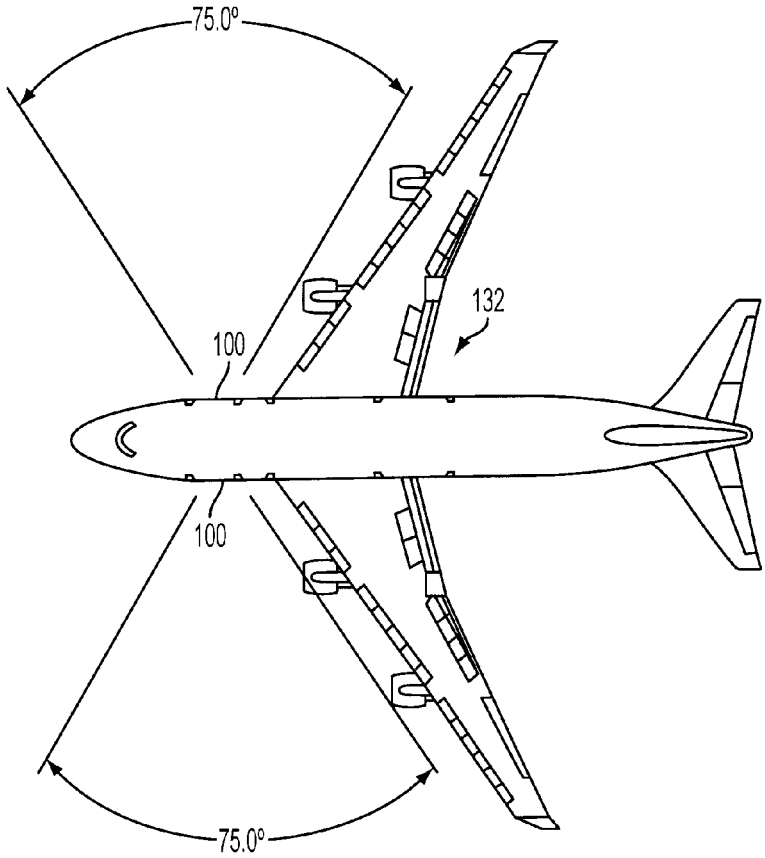
FIG. 4 illustrates an example of horizontal coverage achieved by the antenna assembly as shown in FIG. 1.
Figure 5:
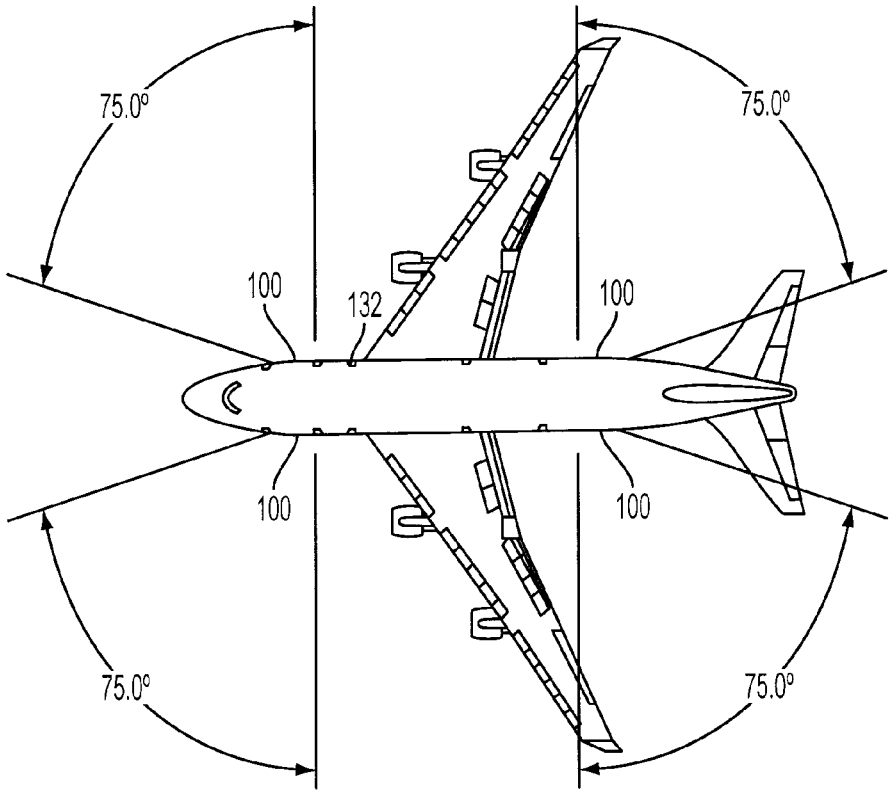
FIG. 5 illustrates an example of forward and aft coverage achieved by the antenna assembly as shown in FIG. 2.

For example, FIGS. 3-5 illustrate examples of an aircraft 132 having the antenna assembly 100 as shown in FIGS. 1 and 2 installed at certain locations. As shown in FIGS. 3 and 4, two antenna assemblies 100 are installed in window assemblies 106 on opposite sides of the aircraft 132 near the nose of the aircraft 132. These antenna assemblies 100 each provide a range of coverage of at or about 15 degrees in the vertical direction, and at or about 75 degrees in the horizontal direction. As illustrated in FIG. 5, two antenna assemblies are installed in window assemblies on opposite sides of the aircraft 132 near the nose of the aircraft 132, and two antenna assemblies 100 are installed in window assemblies 106 on opposite sides of the aircraft 132 near the tail of the aircraft. These antenna assemblies 100 can also each provide a range of coverage of at or about 15 degrees in the vertical direction, and at or about 75 degrees in the horizontal direction. As further shown, the antenna assemblies 100 are steered to direct the range of coverage more toward the nose and tail of the aircraft 132.

Accordingly, the antenna assemblies 100 enable the aircraft 132 to communicate with, for example, base stations or repeaters of a MAN, that can be perhaps 3 miles to 5 miles or more away from the airport, using technology such a IEEE 802.16. The antenna assemblies 100 further enable aircraft 132 to communicate with each other, particularly while on the ground, to thus create a wireless mesh networks between aircraft 132 and the base stations and repeaters.

As can be further appreciated from the above, the antenna assembly 100 does not penetrate the skin of the aircraft 132 during installation, does not require special materials for mounting, and is easy to install and access.

Figure 6:
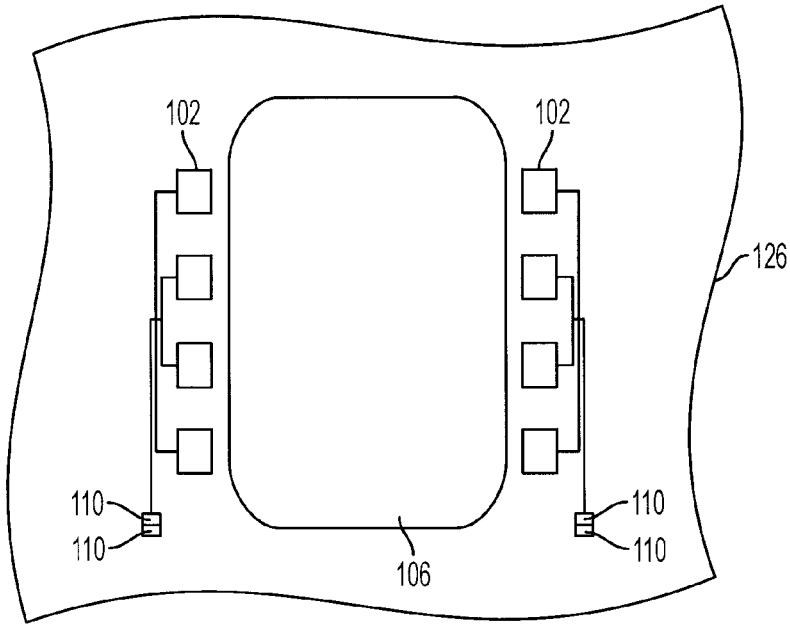
FIG. 6 illustrates and example of antenna elements that are attached to a side-wall liner that surrounds and inside window of an aircraft according to another embodiment of the present invention.

As an alternative to the arrangements discussed above, the antenna assembly 100 can be attached to the plug placed in a window location that is covered by other aircraft equipment, such as in a galley, closet, or lavatory. Also, as shown in FIG. 6, the antenna elements 102 can be etched onto, or otherwise fastened to, the plastic of the side-wall liner 126 that circles the window assembly 118 rather than to the inner window 120 itself. This would permit the antenna elements 102 to be hidden.

Although only a few exemplary embodiments of the present invention have been described in detail above, those skilled in the art will readily appreciate that many modifications are possible in the exemplary embodiments without materially departing from the novel teachings and advantages of this invention. For example, the order and functionality of the steps shown in the processes may be modified in some respects without departing from the spirit of the present invention. Accordingly, all such modifications are intended to be included within the scope of this invention.

What is claimed is:

1. An antenna assembly for an aircraft, comprising:

at least one antenna element, attached to a portion of an interior liner of the aircraft proximate to a location in the interior liner where an interior window of the aircraft is located.

2. An antenna assembly as claimed in claim 1, wherein:

the at least one antenna element is etched onto the portion of the interior liner.

3. An antenna assembly as claimed in claim 1, wherein:

the at least one antenna element comprises a plurality of antenna elements.

4. An antenna assembly as claimed in claim 3, further comprising:

a plurality of conductors, adapted to electrically couple the antenna elements.

5. An antenna assembly as claimed in claim 3, wherein:

a first group of the plurality of antenna elements are positioned in the interior liner proximate to a first side of the interior window and a second group of the plurality of antenna elements are positioned in the interior liner proximate to a second side of the interior window.

6. An antenna assembly as claimed in claim 5, wherein an equal number of the antenna elements are in the first and second groups.

7. An antenna assembly as claimed in claim 6, wherein the equal number of the antenna elements is greater than one.

8. An antenna assembly as claimed in claim 5, wherein the antenna elements in the first and second groups are disposed vertically along the first and second sides of the interior window.

9. An antenna assembly as claimed in claim 1, wherein:

the at least one antenna element is positioned in a side-looking direction with respect to the aircraft to provide the antenna assembly with a coverage area of about 15 degrees in a vertical direction with respect to the aircraft.

10. An antenna assembly as claimed in claim 1, wherein:

the at least one antenna element is positioned in a side-looking direction with respect to the aircraft to provide the antenna assembly with a coverage area of about 75 degrees in a horizontal direction with respect to the aircraft.

11. An antenna assembly as claimed in claim 1, wherein the at least one antenna element is a transmit and receive antenna element.

12. An antenna assembly as claimed in claim 1, further comprising a controller that uses the at least one antenna element to perform beam steering in horizontal directions.

13. An antenna assembly as claimed in claim 1, wherein the at least one antenna element facilitates communication with a metro area network using an IEEE 802.16 protocol.

14. A method for installing an antenna assembly in an aircraft, comprising:

providing at least one antenna element; and attaching the at least one antenna element to a portion of an interior liner of the aircraft proximate to a location in the interior liner where an interior window of the aircraft is located.

15. A method as claimed in claim 14, wherein:

the attaching comprises etching the at least one antenna element onto the portion of the interior liner.

16. A method as claimed in claim 14, wherein:

the at least one antenna element comprises a plurality of antenna elements.

17. A method as claimed in claim 16, further comprising:

electrically coupling the antenna elements to each other.

18. A method as claimed in claim 16, wherein:

the attaching comprises positioning a first group of the plurality of antenna elements in the interior liner proximate to a first side of the interior window and a second group of the plurality of antenna elements in the interior liner proximate to a second side of the interior window.

19. A method as claimed in claim 18, wherein an equal number of the antenna elements are in the first and second groups.

20. A method as claimed in claim 19, wherein the equal number of the antenna elements is greater than one.

21. A method as claimed in claim 18, wherein the attaching comprises disposing the antenna elements in the first and second groups vertically along the first and second sides of the interior window.

22. A method as claimed in claim 14, wherein:

the attaching comprises positioning the at least one antenna element in a side-looking direction with respect to the aircraft to provide the antenna assembly with a coverage area of about 15 degrees in a vertical direction with respect to the aircraft.

23. A method as claimed in claim 14, wherein:

the attaching comprises positioning the at least one antenna element in a side-looking direction with respect to the aircraft to provide the antenna assembly with a coverage area of about 75 degrees in a horizontal direction with respect to the aircraft.

24. A method as claimed in claim 14, wherein the at least one antenna element is a transmit and receive antenna element.

25. A method as claimed in claim 14, wherein the attaching comprises positioning the at least one antenna element to facilitate performing beam steering in horizontal directions.

26. A method as claimed in claim 14, wherein the at least one antenna element facilitates communication with a metro area network using an IEEE 802.16 protocol.

27. An antenna assembly for an aircraft, comprising:

a plurality of groups of antenna elements, each group including a plurality of antenna elements, each antenna element attached to a portion of an interior liner of the aircraft proximate to a location in the interior liner where an interior window of the aircraft is located, wherein the plurality of groups are installed at different regions of the aircraft such that each of the plurality of groups provide a different range of coverage in the horizontal direction than the other groups.

28. An antenna assembly as claimed in claim 27, wherein at least two groups are installed at opposite sides of the aircraft near the tail of the aircraft.

29. An antenna assembly as claimed in claim 27, wherein at least two groups are installed at opposite sides of the aircraft near the nose of the aircraft.

30. An antenna assembly as claimed in claim 27, wherein at least two groups are installed at opposite sides of the aircraft near the tail of the aircraft and at least two groups are installed at opposite sides of the aircraft near the nose of the aircraft.

31. An antenna assembly as claimed in claim 27, further comprising a controller that uses the plurality of antenna element to perform beam steering in horizontal directions to direct a range of coverage more toward the nose and tail of the aircraft.

* * * * *

UNITED STATES PATENT AND TRADEMARK OFFICE

CERTIFICATE OF CORRECTION

PATENT NO. : 8,059,043 B2
APPLICATION NO. : 12/620741
DATED : November 15, 2011
INVENTOR(S) : Brady, Jr. et al.

It is certified that error appears in the above-identified patent and that said Letters Patent is hereby corrected as shown below:

In the Patent:

Column 1, Line 14: Please correct "1.Field of the Invention"
to read -- Field of the Invention --

Line 21: Please correct "2.Description of the Related Art"
to read -- Description of the Related Art --

Signed and Sealed this
Seventh Day of February, 2012

David J. Kappos

David J. Kappos
*Director of the United States Patent and Trademark Office*